US005937459A

United States Patent [19]

Binaghi et al.

[11] Patent Number: 5,937,459

[45] Date of Patent: Aug. 17, 1999

[54] PILLOW LIFTING DEVICE, PARTICULARLY FOR BEDS AND THE LIKE

[76] Inventors: Giovanni Binaghi, Via Morandi 3-20090, Buccinasco; Luigi Federico Binaghi, Viale Faenza 1-20142, Milano, both of Italy

[21] Appl. No.: 08/891,782

[22] Filed: Jul. 14, 1997

[30] Foreign Application Priority Data

Jul. 15, 1996 [IT] Italy ..... MI96A01464

[51] Int. Cl.[6] ..... A47C 20/12; B66F 3/10

[52] U.S. Cl. ..... 5/634; 5/633; 74/89.15; 254/102

[58] Field of Search ..... 5/633, 634, 613, 5/616, 617, 618; 74/89.15, 586; 254/102, 126

[56] References Cited

U.S. PATENT DOCUMENTS

| | | | |
|---|---|---|---|
| 2,663,029 | 12/1953 | Whitley et al. | 5/634 |
| 2,829,383 | 4/1958 | Creeger . | |
| 3,931,653 | 1/1976 | Bien | 5/634 |
| 4,583,713 | 4/1986 | Fukura et al. | 254/126 |
| 4,853,990 | 8/1989 | Elder et al. | 5/634 |
| 4,949,985 | 8/1990 | Dauvegne et al. | 254/102 X |
| 5,556,165 | 9/1996 | Pickles | 74/89.15 X |

FOREIGN PATENT DOCUMENTS

| | | | |
|---|---|---|---|
| 4 485 60 | 10/1912 | France . | |
| 589 353 | 5/1925 | France . | |
| 691204 | 10/1930 | France | 254/126 |
| 1377482 | 9/1964 | France | 5/634 |
| 2 177 241 | 11/1973 | France . | |
| 69 670 | 7/1893 | Germany . | |
| 156 254 | 11/1904 | Germany . | |
| 232 749 | 3/1911 | Germany . | |
| 3 239 077 | 4/1984 | Germany . | |
| 9 319 978 | 2/1994 | Germany . | |
| 9 413 740 | 1/1996 | Germany . | |

OTHER PUBLICATIONS

Patent Abstracts of Japan vol. 008, No. 094 (M–293), Apr. 28, 1984 & JP 59 009350 A (Hitachi Seisakusho KK/, Jan. 18, 1984, * abstract*.

*Primary Examiner*—Brian K. Green
*Assistant Examiner*—Robert G. Santos
*Attorney, Agent, or Firm*—Guido Modiano; Albert Josif

[57] ABSTRACT

A pillow lifting device particularly for beds and the like, including: a first fixed structure, which can be arranged at the region where the user's head is meant to rest; a second structure, which is pivoted to the first fixed structure at one end and is suitable to support a pillow; and elements for lifting/lowering the second structure with respect to the first fixed structure, which are constituted by at least one elongated element actuated by a motor.

7 Claims, 9 Drawing Sheets

PILLOW LIFTING DEVICE, PARTICULARLY FOR BEDS AND THE LIKE

BACKGROUND OF THE INVENTION

The present invention relates to a pillow lifting device, particularly for beds and the like.

More particularly, the invention relates to a device for lifting a portion of the bed which can be either the mattress or the bedspring with the mattress rested thereon or only the pillow at the bedhead or at the foot of the bed.

Beds are currently known in which the pillow, or the end portion of the mattress where the head of the user is placed, can be lifted on command in a motorized manner so as to vary the inclination of said pillow.

This allows to choose at will the most appropriate resting position for comfort and for therapeutic purposes.

The proposed solution for lifting the pillow of a bed has a first rectangular fixed structure which can be placed below the pillow and to which a second rectangular structure is hinged at one end. The other end of the second rectangular structure is connected to the first fixed rectangular structure by means of a parallelogram-shaped element which causes the first and second rectangular structures to mutually overlap when it is in closed position. The opening movement of the parallelogram-shaped element lifts the second structure with respect to the first one.

A severe drawback related to the above embodiment can be found in the large amount of power required for pickup for the corresponding lifting of the second structure with respect to the first one.

This entails the need to use a high-power motor, with consequent obvious drawbacks in terms of costs, size, noise in operation and difficulty in implementation.

SUMMARY OF THE INVENTION

The aim of the present invention is to provide a pillow lifting device, particularly for beds and the like, which entails the use of a less powerful motor than adopted in the prior art.

Within the scope of this aim, an object of the present invention is to provide a pillow lifting device, particularly for beds and the like, in which the lifting movement is linear and free from sudden jolts.

Another object of the present invention is to provide a pillow lifting device which can be arranged both under the pillow of the bed and under the mattress, at the head resting region, or under the bedspring.

Another object of the present invention is to provide a pillow lifting device, particularly for beds and the like, which has safety means for stopping the motor at the end of the lifting or lowering stroke.

Another object of the present invention is to provide a pillow lifting device, particularly for beds and the like, which is highly reliable, relatively easy to manufacture, and at competitive costs.

This aim, these objects and others which will become apparent hereinafter are achieved by a pillow lifting device particularly for beds and the like, characterized in that it comprises: a first fixed structure, which can be arranged at the region where the user's head is meant to rest; a second structure, which is pivoted to said first fixed structure at one end and is suitable to support a pillow; and means for lifting/lowering said second structure with respect to said first fixed structure constituted by at least one elongated element actuated by motor means.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

In the various figures, identical reference numerals designate identical elements.

DESCRIPTION OF THE PREFERRED EMBODIMENTS

Figure 1:
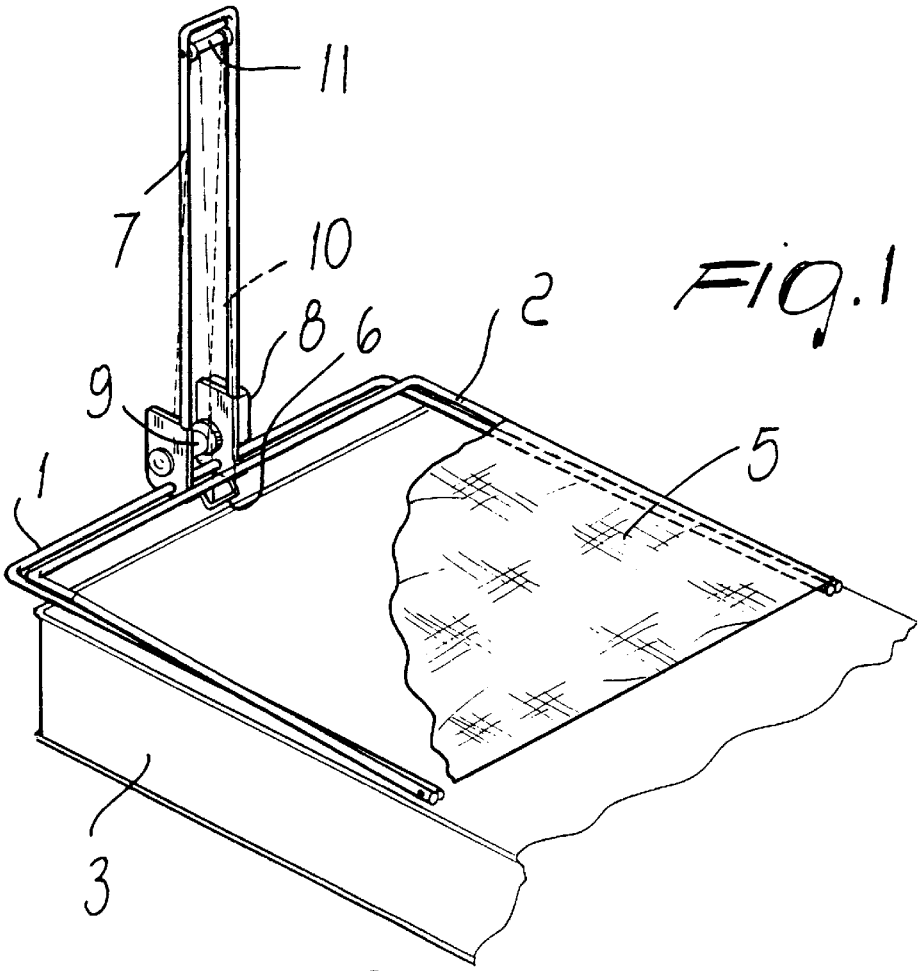
FIG. 1 is a perspective view of a first embodiment of the device according to the invention in closed position.

With reference to FIGS. 1 to 6, a first embodiment of the device according to the invention comprises a first fixed tubular structure 1, which is for example rectangular and to which a second likewise tubular structure 2 is hinged at one end. The second structure is shorter than the first structure 1.

The first structure 1 and the second structure 2 hinged thereto can be arranged on a resting surface 3 (for example the mattress or the structure of the bed) of the bed whose pillow 4 one wishes to lift.

The end of the structure 2 that lies opposite to the hinge point has a configuration which bends downward. The second structure 2 is covered by a canvas 5 or by similar elements meant to support the pillow 4.

At the downward-bending portion, the structure 2 is provided with engagement means advantageously provided by a handle 6, which is directed downward in order to increase the maximum inclination angle for an equal height of the elongated element.

The second structure 2 can move so as to lift or lower with respect to the first fixed structure 1 and the pillow 4 can move therewith, in the manner explained hereinafter.

The first structure 1 has lifting/lowering means which are rigidly coupled thereto and advantageously comprise a supporting element 7, which protrudes vertically from the structure 1, and a gearmotor 8 connected thereto. The supporting element 7 can be inclined along the vertical axis with respect to the fixed structure 1.

The gearmotor 8 actuates a first winding/unwinding roller 9, to which a traction element is fixed; said traction element is conveniently constituted by a belt 10. The roller 9 is pivoted at one end to a first supporting plate, to which the gearmotor 8 is connected, and is pivoted at the other end to a second supporting plate 26 which faces the gearmotor 8.

The supporting element 7 protrudes from the supporting plates.

Both supporting plates have a resting notch 25 which is suitable to allow the resting of the structure 2 in the lowered configuration.

A second roller 11 is arranged opposite with respect to the first roller 9 and is supported by the supporting element 7 so that it can rotate about its own axis.

Figure 4:
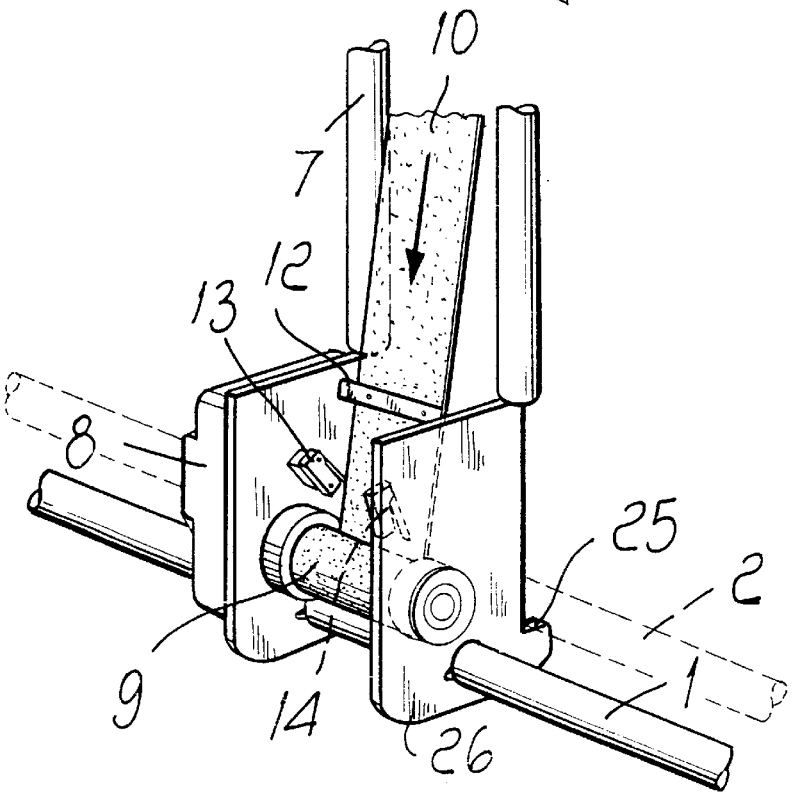
FIG. 4 is a perspective view, with some parts shown in dashed lines, of a detail of the device according to the invention, shown in FIGS. 1–3.
Figure 2:
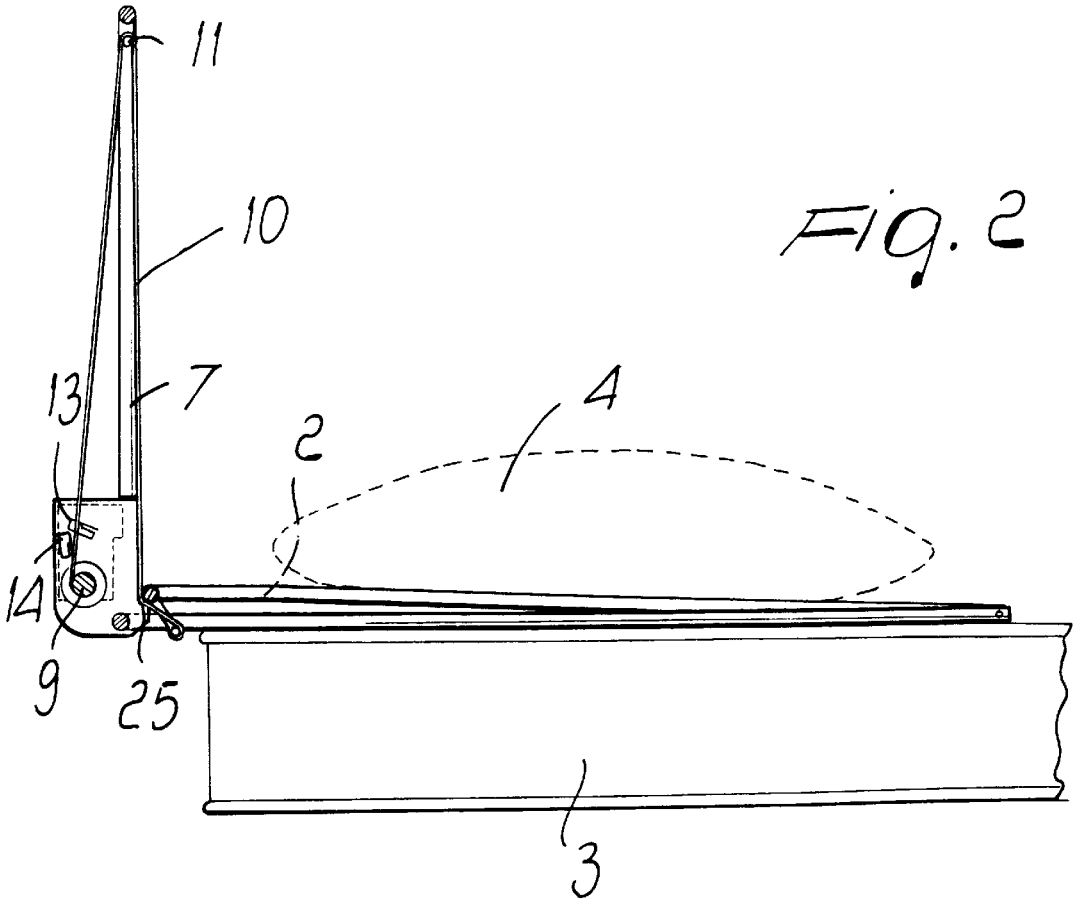
FIG. 2 is a side view of the device according to the invention shown in FIG. 1, again in the closed or lowered position.
Figure 3:
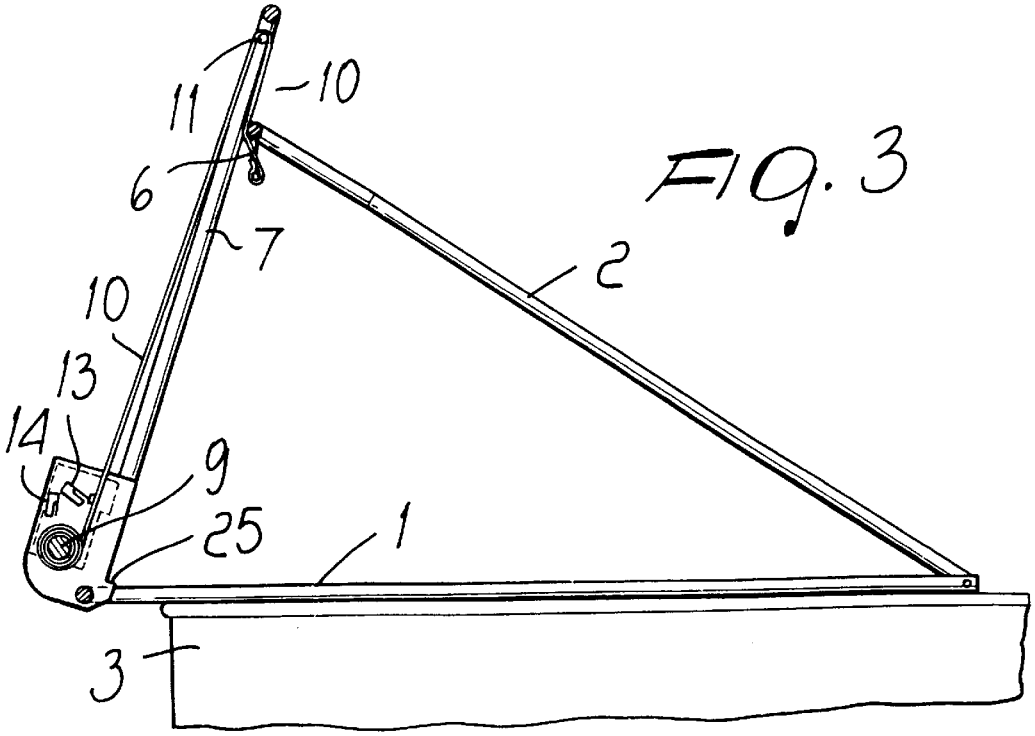
FIG. 3 is a side view of the device according to the invention shown in FIGS. 1 and 2, in the raised position.
Figure 5:
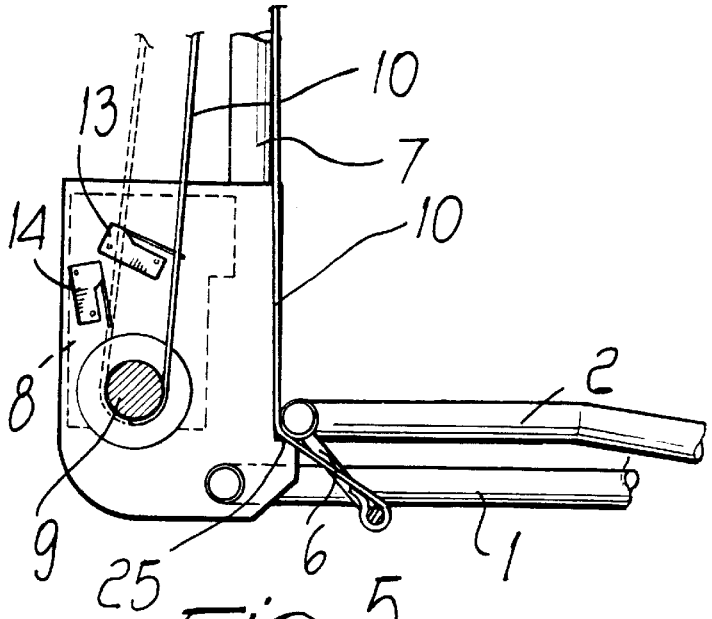
FIG. 5 is a side view of the detail of the device according to the invention shown in FIG. 4.
Figure 6:
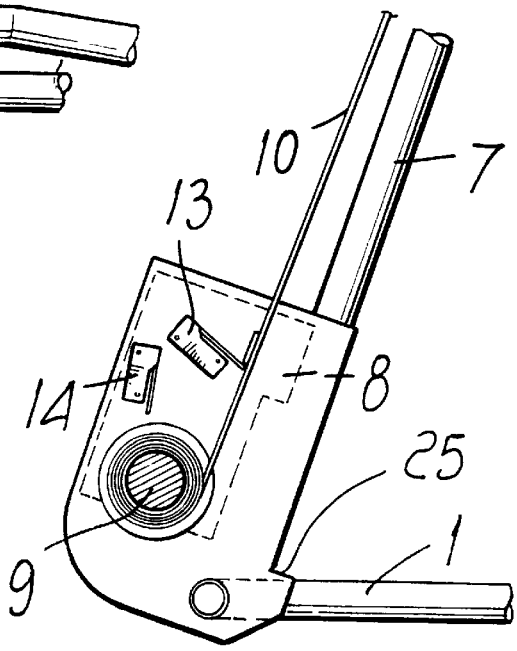
FIG. 6 is a side view of the detail of the device according to the invention shown in FIGS. 4 and 5 in the lifting stroke limit position.

The belt 10 passes around the second roller 11 and engages the handle 6 (or optionally the structure), as shown in detail in FIG. 4.

In the closed position, i.e., when the structure 2 is parallel to the structure 1, the belt 10 is completely unwound from the first roller 9.

The device according to the invention furthermore has stroke limit locking means, which are suitable to interrupt the power supply of the gearmotor 8 when the movable structure 2 has reached its maximum opening (maximum possible angle with respect to a horizontal plane) or its minimum opening (the structure 2 is parallel to the structure 1).

The stroke limit locking means conveniently comprise: a rod 12 (see FIG. 4 in particular) which is connected transversely to the belt 10 and protrudes laterally from it; a first microswitch 13; and a second microswitch 14.

The rod 12 is arranged on the belt portion 10 so as to engage the first microswitch 13 when the belt 10 is fully wound onto the first roller 9 and therefore the structure 2 is in a fully raised position.

The two microswitches 13 and 14 are arranged on the supporting element 7 in a position which is adjacent to the guide in which the belt 10 moves, and are arranged on opposite sides of the lower portion of the supporting element 7.

The first microswitch 13 and the rod 12 constitute the rising stroke limit locking means, accordingly meant to interrupt the power supply of the gearmotor 8 when its rotation direction is such as to wind the belt 10 onto the first roller 9, whilst the second microswitch 14 constitutes the stroke limit locking means for descent, i.e., for when the rotation direction of the gearmotor 8 is such as to unwind the belt 10 from the first roller 9 (in this case, therefore, the second structure 2 lowers until it is arranged horizontally with respect to the first structure 1) until it would wind in the opposite direction once unwinding has been completed.

With reference to the above FIGS. 1 to 6, operation of the device according to the present invention is as follows.

The motor 8, together with the corresponding gearmotor 8, actuated by a switch (not shown), allow the user to vary at will the inclination of the second structure 2 which supports the pillow 4.

If the user wishes to tilt the second movable structure 2, the rotation direction of the gearmotor 8 is such as to make the first roller 9 actuated thereby rotate about its own axis, so that the belt 10 winds onto said first roller 9.

The winding of the belt 10, which runs around the second roller 11 as it moves, lifts the second movable structure 2 with respect to the first structure 1.

As it rises, the movable structure 2 remains constantly in abutment against the structure 1.

If the user instead wishes to lower said movable structure 2, the rotation direction of the gearmotor 8 is opposite to the preceding one and the belt is unwound from the roller 9.

In order to prevent the gearmotor 8 from burning out when it reaches the upper stroke limit position (in which the structure 2 is completely raised), the stroke limit element is activated.

In the case of the lifting of the structure 2 with respect to the structure 1, the rod 12, at the point of maximum lifting of said structure, engages the microswitch 13, which disconnects the power supply from the gearmotor 8 and consequently stops said gearmotor.

In the case of the lowering of the movable structure 2, when the belt 10 is fully unwound from the roller 9 and would tend to rewind onto said roller in the opposite direction with respect to the correct direction, changing its point of tangency thereto, this change in the point of tangency of the belt causing the belt 10 to engage the second microswitch 14, which is arranged on the opposite side of the first roller 9 with respect to the first microswitch 13.

In this manner, the power supply is disconnected from the gearmotor 8 also during the lowering of the movable structure 2 in order to prevent damage to said gearmotor.

After the gearmotor 8 has stopped because a chosen lifting position of the structure 2 has been reached, the two inputs of the power supply of the gearmotor 8 are shortcircuited so as to produce a counterelectromotive force which allows the structure 2 to maintain the lifting position it has reached, thus avoiding its unwanted lowering.

This characteristic of shorting the power supply is also present in every one of the embodiments described hereinafter.

Figure 8:
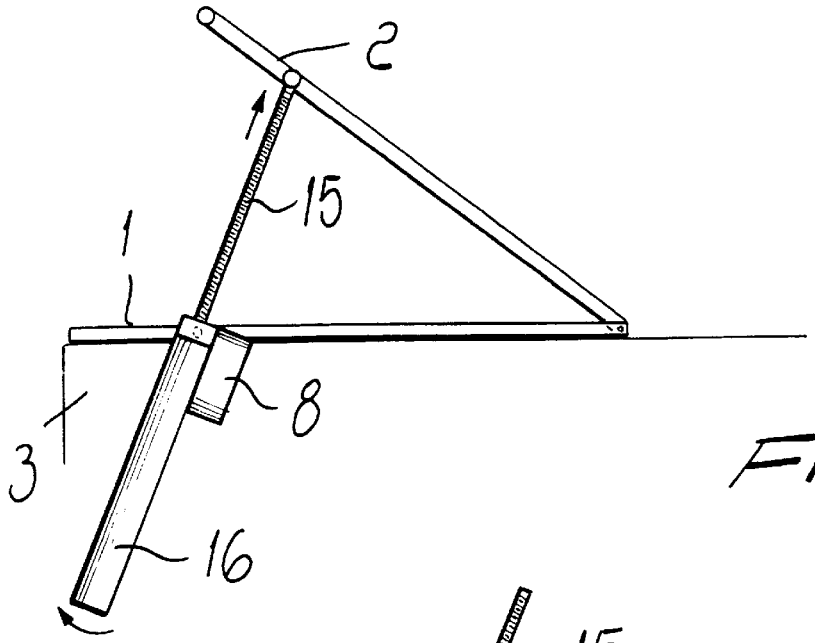
FIG. 8 is a side view of a second embodiment of the device according to the invention.

FIG. 8 instead shows a second embodiment of the device according to the invention.

In this second embodiment, the gearmotor 8 drives a female thread, which by rotating causes the translatory motion of a worm screw 15 (threaded bar) which is rigidly coupled to the female thread at one end and to the movable structure 2 at the opposite end.

The threaded bar 15 slides within a protective sheath 16.

The gearmotor 8 can also be arranged so that it is rigidly coupled to the structure 2.

Figure 10:
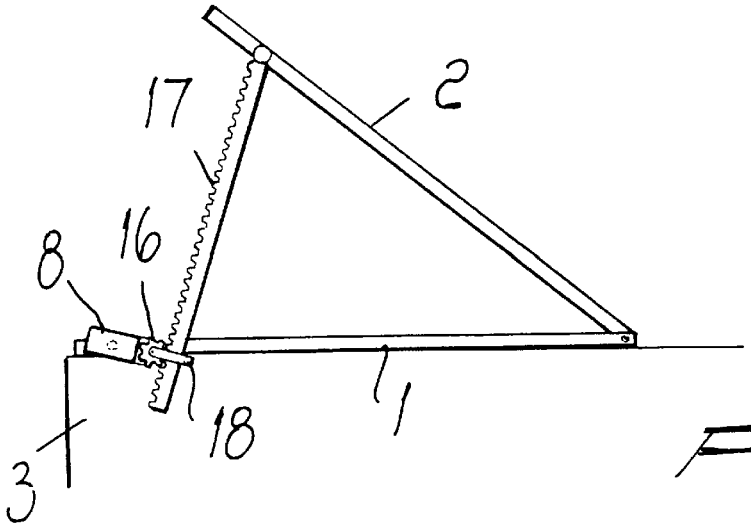
FIG. 10 is a side view of a third embodiment of the device according to the invention.

FIG. 10 is a view of a third embodiment of the device according to the invention.

In this third embodiment, the gearmotor 8, rigidly coupled to the first structure 1, drives a pinion 16 which is suitable to engage a rack 17.

The rack 17 is fixed to the second movable structure 2 at a first end, whilst its other end can move freely by engagement with the pinion 16.

A U-shaped element 18 ensures contact between the pinion 16 and the rack 17.

During the lifting and lowering movements, the rack 17 performs a translatory motion.

Figure 13:
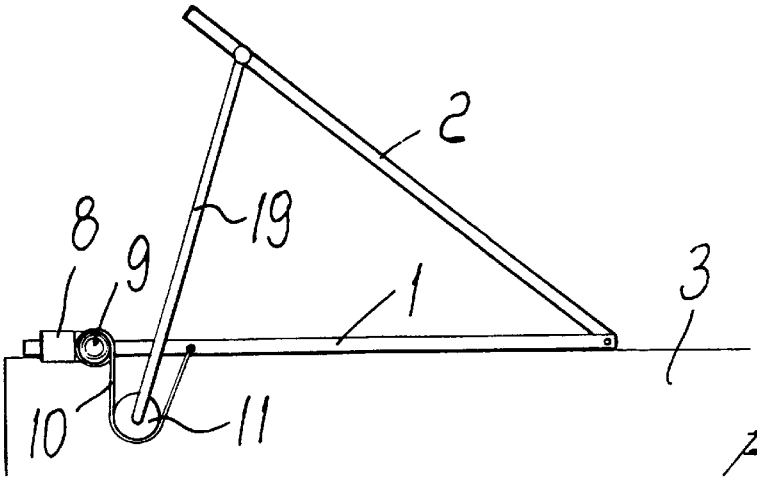
FIG. 13 is a side view of a fourth embodiment of the device according to the invention.

FIG. 13 is a view of a fourth embodiment of the device according to the invention.

In this fourth embodiment, the gearmotor 8 is rigidly coupled to the first structure 1 and drives a roller 9 (similar to the roller 9 of the first embodiment) for winding and unwinding the belt 10.

Differently from the first embodiment, a rod-like element 19 is hinged at the free end of the movable structure 2.

A rotating element 11 (similar to the roller 11) is provided at the end of the rod-like element 19 that lies opposite to the hinge point, and the belt 10 passes around it. In turn, the belt 10 is furthermore fixed to the structure 1.

The belt 10 can be optionally fixed to the element 19, which is guided appropriately.

Operation of the fourth embodiment is as follows.

Actuation of the roller 9 by the gearmotor 8 causes, in one direction of rotation of the gearmotor, the unwinding of the belt 10 from the roller 9 and therefore the lowering of the rod-like element 19 and of the movable structure 2 which is rigidly coupled thereto.

In the opposite rotation direction of the gearmotor 8, the rotation of the roller 9 winds the belt 10 on said roller and accordingly lifts the rod-like element 19 and the movable structure 2.

Figure 15:
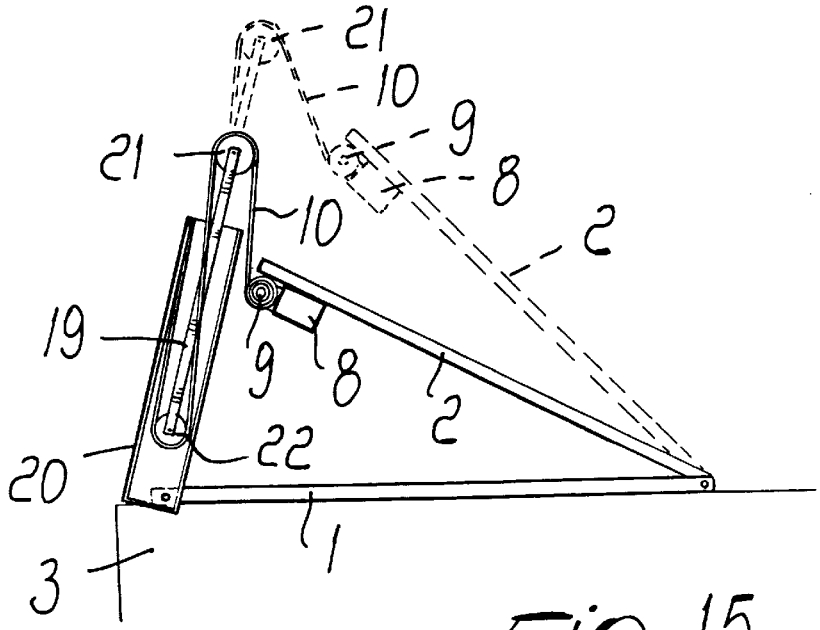
FIG. 15 is a side view of a fifth embodiment of the device according to the invention.

FIG. 15 is a view of a fifth embodiment of the device according to the invention, wherein the useful length of the elongated element is variable, reducing its length when inactive.

In this embodiment, the gearmotor 8 is rigidly coupled to the second structure, whilst the rod-like element 19 is now supported exclusively by the belt 10, which passes around its ends provided with pulleys 21 and 22.

The end of the belt 10 which lies opposite to the end coupled to the roller 9 is coupled to a container 20 which is pivoted to the first structure 1 and contains the rod-like element 19 and the belt 10.

Operation of the fifth embodiment is as follows.

The winding of the belt 10 on the roller 9 lifts the movable structure 2: the rod-like element 19, as a consequence of the winding of the belt 10, rises within the container 20; therefore the belt portion 10 arranged inside said container 20 becomes available.

In this manner, the bulk of the device according to the invention is reduced, since the rod-like element 19 is accommodated within the container 20 when the belt is fully unwound from the roller 9, i.e., when the structure 2 is fully lowered.

Figure 16:
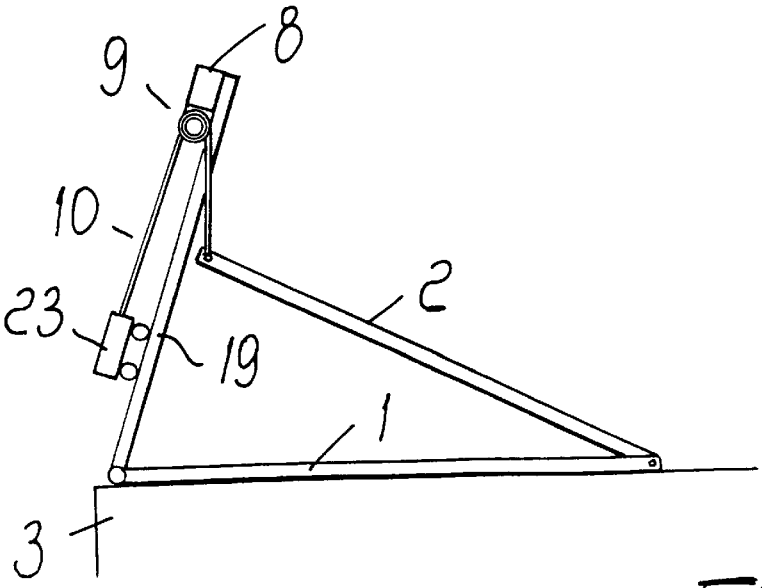
FIG. 16 is a side view of a sixth embodiment of the device according to the invention.

FIG. 16 is a view of the sixth embodiment of the device according to the invention.

In this sixth embodiment, the rod-like element 19 is pivoted to the structure 1 at one end. The free end of the rod-like element 19 supports the gearmotor 8 and the roller 9.

The belt 10 is wound around the roller 9 and is coupled to the free end of the movable structure 2 at one end and to a counterweight 23 at the other end.

The counterweight 23 is constituted for example by a carriage 23 which can slide on the rod-like element 19 as a consequence of the unwinding/winding of the belt 10 on the roller 9.

In this manner, in the operation of the sixth embodiment of the device according to the invention part of the actuation energy is provided by the counterweight.

This counterweight 23 can also be applied to the previous embodiments.

Figure 18:
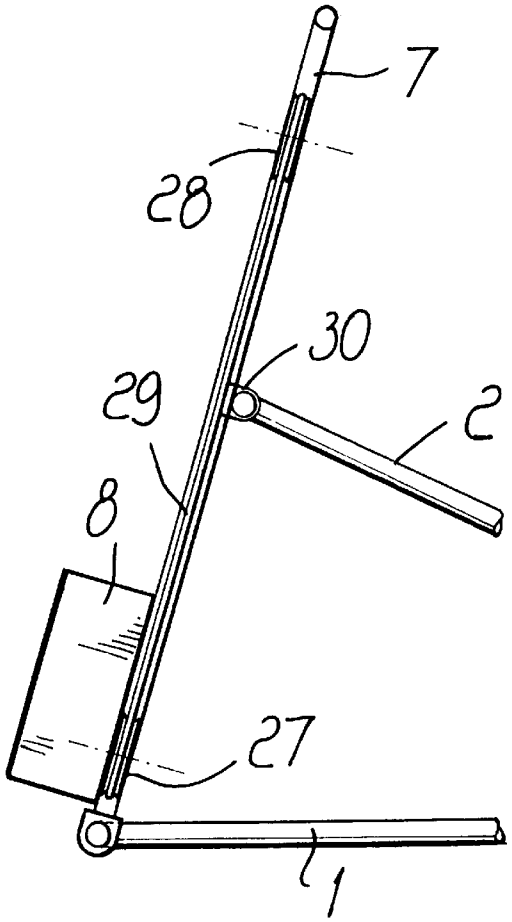
FIG. 18 is a side view of the seventh embodiment of the device according to the invention, shown in FIG. 17.
Figure 17:
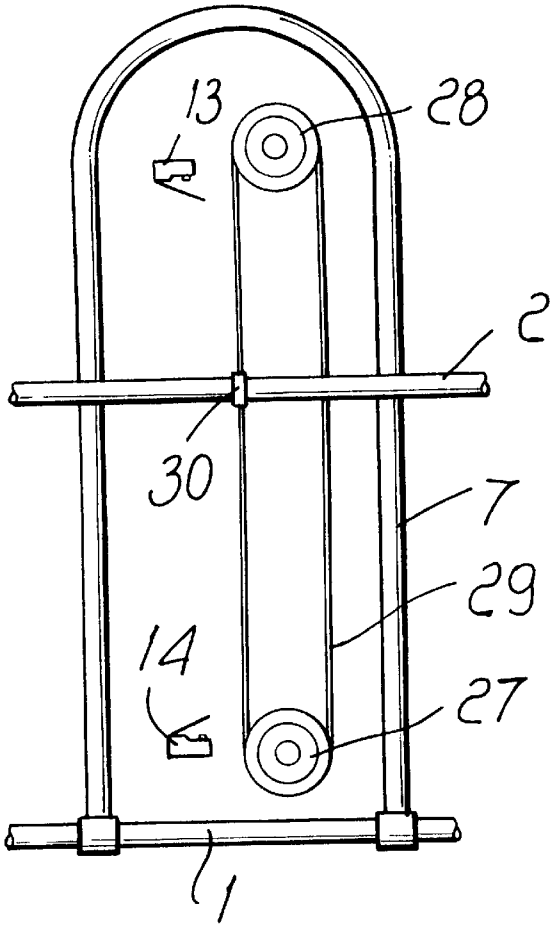
FIG. 17 is a plan view of a seventh embodiment of the device according to the invention.

FIGS. 17 and 18 are views of the seventh embodiment of the device according to the invention.

In this embodiment, the supporting element is movably fixed to the fixed structure 1. The lifting and lowering means in this case comprise a driving wheel 27 actuated by the gearmotor 8, a toothed belt or endless chain 29, and a driven wheel 28.

The second structure 2 is fixed to the toothed belt 29 by means of a U-shaped element or a similar fixing element 30 and is therefore suitable to perform a translatory motion, in contact with the supporting element 7, along the supporting element itself.

Figure 20:
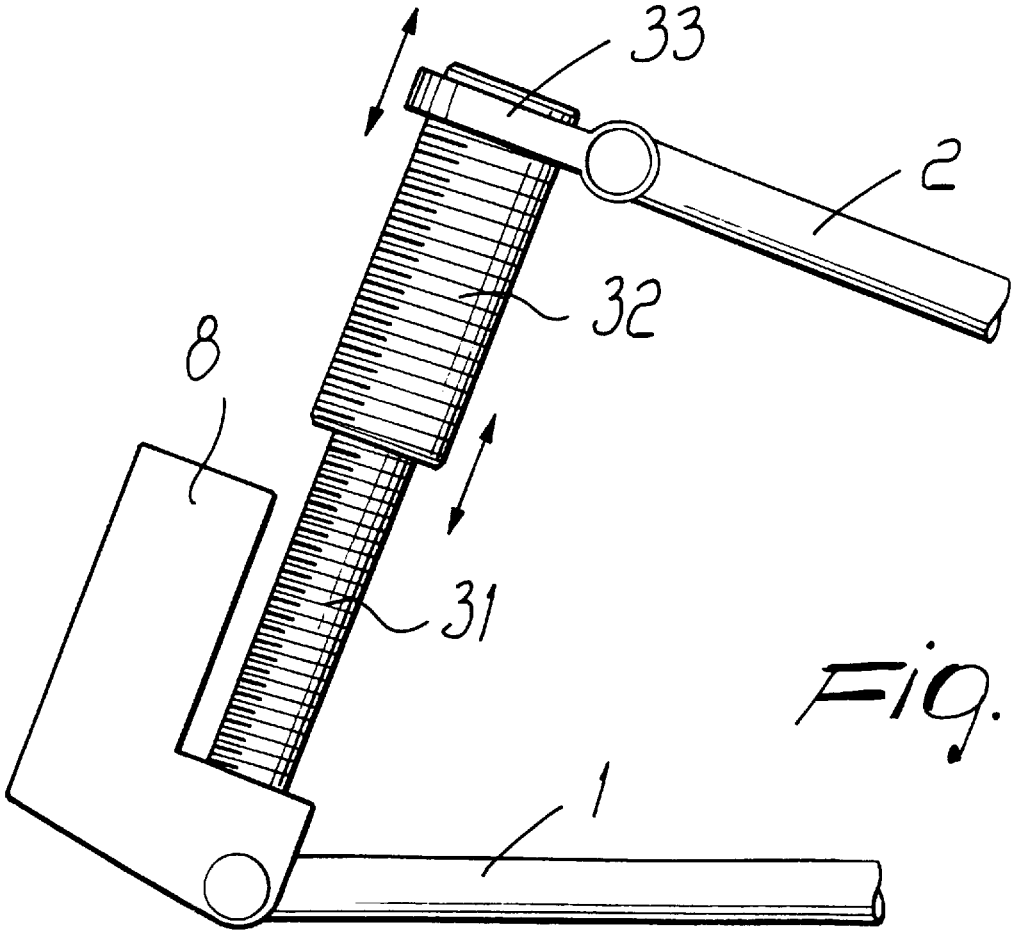
FIG. 20 is a side view of an eighth embodiment of the device according to the invention.

FIG. 20 is a view of the eighth embodiment of the device according to the invention.

In this embodiment, a threaded bar 31 is fixed to the fixed structure 1 and enters an internally and externally threaded tube 32.

The threaded tube 32 is screwed into a female thread 33, which is rigidly coupled to the second structure 2.

The threaded bar 31 is actuated by the gearmotor 8.

When the threaded bar 31 rotates, the threaded tube 32 moves with respect thereto up to a limit position, then it too rotates and starts to move the female thread 33 with respect to the threaded tube 32.

As regards the noise produced by the operation of the device according to the invention, executed according to the various above-described embodiments, said noise is directly proportional to the rotation rate of the shaft of the gearmotor 8.

The speed, supply voltage being equal, is higher during the descent of the movable structure 2, since the power of the motor is supplemented by the power of the load, which acts in the direction of motion.

Since the power of the motor during descent is required only to overcome friction in the transmission, a lower supply voltage is used during descent than during lifting in order to limit the rotation rate and thus the noise level.

This voltage drop is provided by means of a resistive circuit on the descent power supply line.

The device according to the invention can be used not only as a pillow lifting device but also to directly lift a portion of said mattress, for example the end portion at the head resting region or at the foot resting region.

In practice it has been observed that the device according to the invention fully achieves the intended aim and objects, since it allows to lift and lower the movable pillow supporting structure without the need to use high pickup power.

The device thus conceived is susceptible of numerous modifications and variations, all of which are within the scope of the inventive concept.

Figure 7:
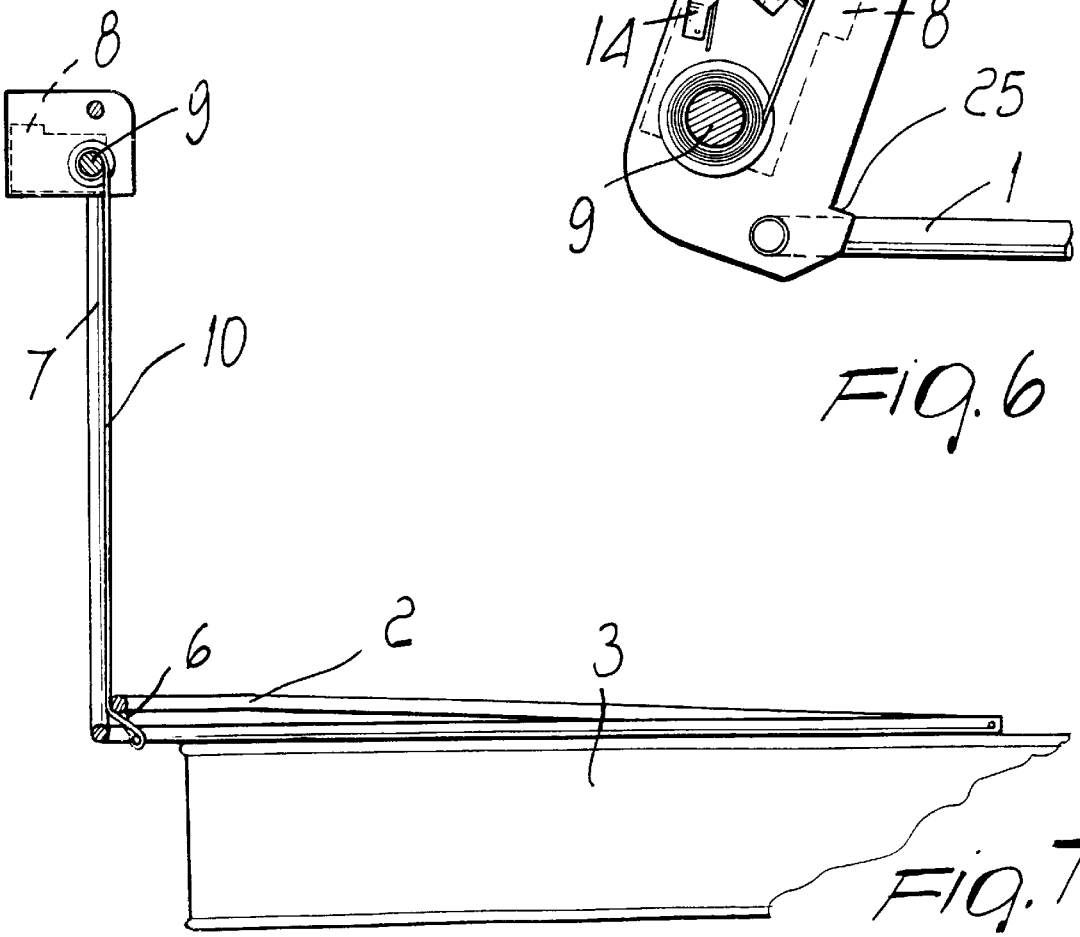
FIG. 7 is a side view of a variation of the first embodiment of the device according to the invention.

Thus, for example, a possible variation of the first embodiment of the device according to the invention is shown in FIG. 7.

In this case, the gearmotor 8 is arranged at the top of the supporting element 7 instead of being located at its lower portion. This arrangement allows to eliminate the second roller 11 and the traction force applied by the belt 10 to lift the movable structure 2 is more direct.

Figure 14:
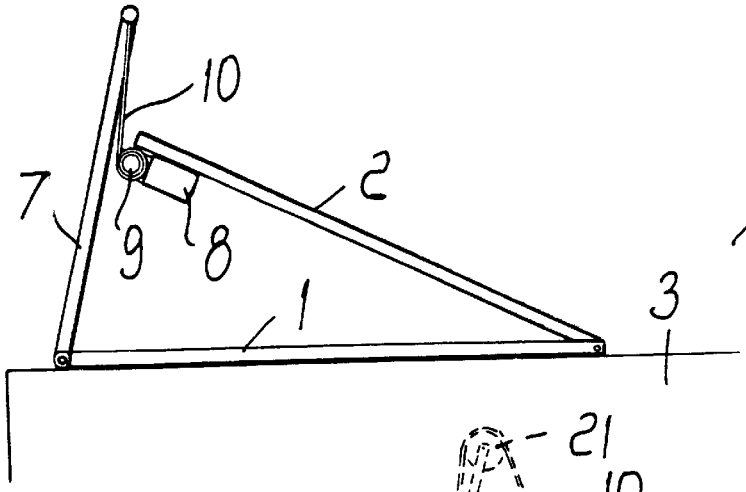
FIG. 14 is a side view of a variation of the first embodiment of the device according to the invention.

FIG. 14 is a view of another possible variation of the first embodiment, wherein the gearmotor 8 is rigidly coupled to the movable structure 2 and the supporting element 7 is pivoted at one of its ends to the structure 1.

The belt 10, actuated so as to wind/unwind on the roller 9, is connected to the free end of the supporting element 7.

The winding of the belt 10 causes the second structure 2 to lift with respect to the first structure 1.

Figure 9:
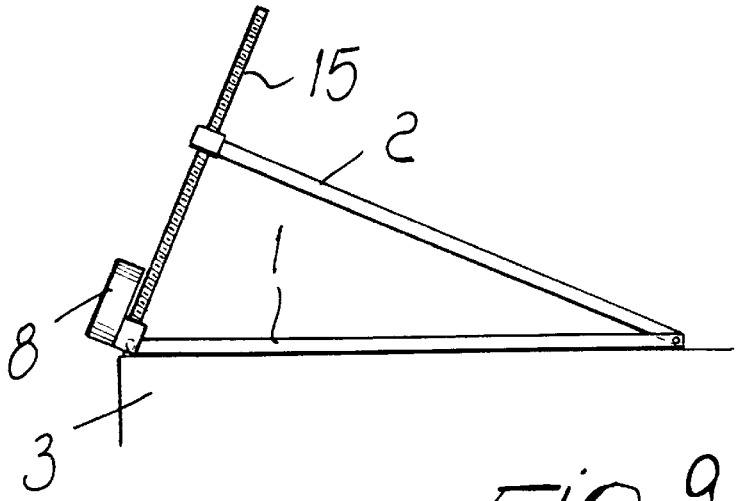
FIG. 9 is a side view of a variation of the second embodiment of the device according to the invention, shown in FIG. 8.

As regards the second embodiment, a possible variation thereof is shown in FIG. 9. Said figure shows how the gearmotor 8 turns the worm screw 15 directly, causing the female thread (not shown) to move along said worm screw, thus lifting and lowering the second movable structure 2 rigidly coupled thereto.

Figure 11:
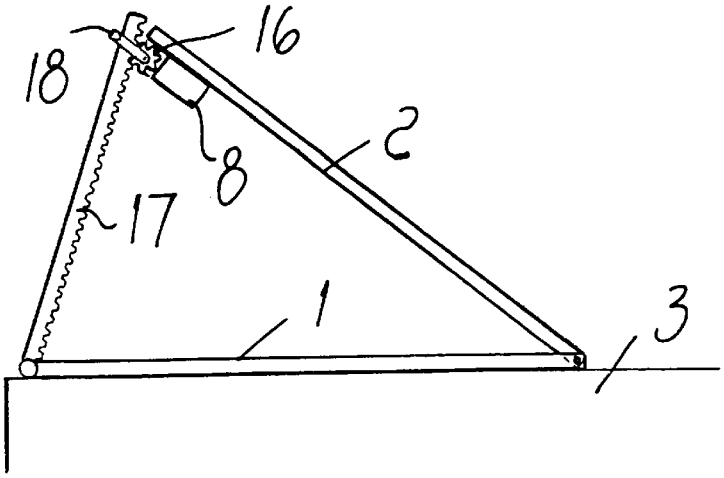
FIG. 11 is a side view of a first variation of the third embodiment of the device according to the invention, shown in FIG. 10.
Figure 12:
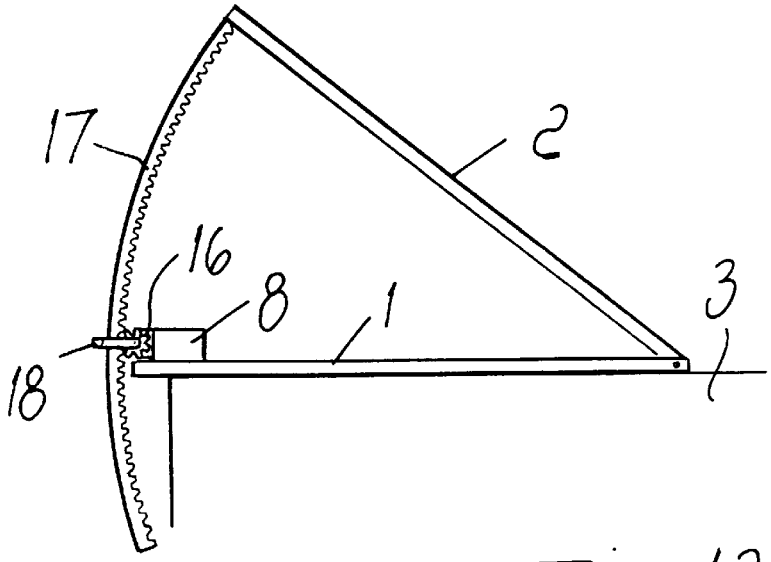
FIG. 12 is a side view of a second variation of the third embodiment shown in FIG. 10.
Figure 19:
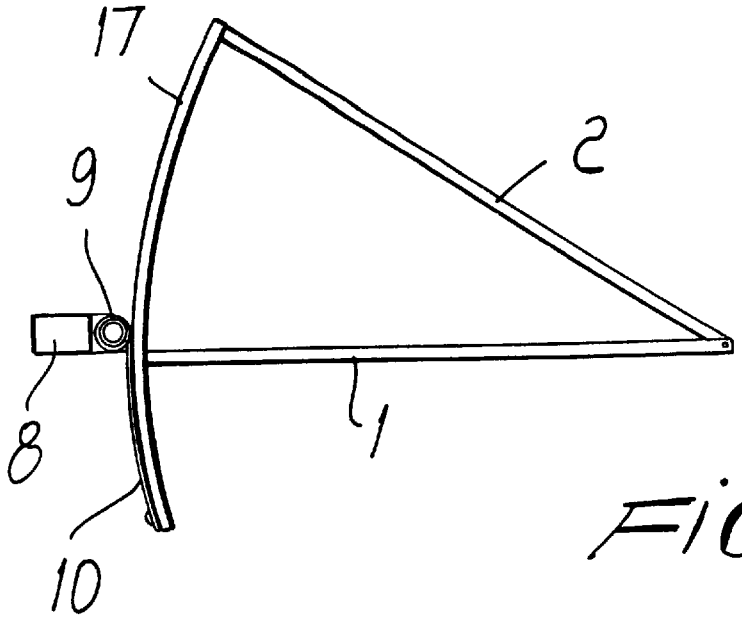
FIG. 19 is a side view of a third variation of the third embodiment shown in FIG. 10.

As regards the third embodiment, FIGS. 11, 12 and 19 are respectively views of first, second and third variations thereof.

With reference to FIG. 11, the gearmotor 8 is rigidly coupled to the free end of the movable structure 2 (the end of the structure 2 that lies opposite to the end that is pivoted to the structure 1). In this case, it is the pinion that performs a translatory motion along the rack 17.

With reference now to FIG. 12, the gearmotor 8 is arranged so that it is rigidly coupled to the first structure 1, but in this case the rack 17 is shaped like a circular arc.

With reference to FIG. 19, the circular arc-like element 17 can be likened to the one shown in FIG. 12. In this case, instead of the pinion 16 and the rack 17 there is a roller 9 on which a belt 10 is wound, the belt being fixed to the end A of the element 17.

Figure 21:
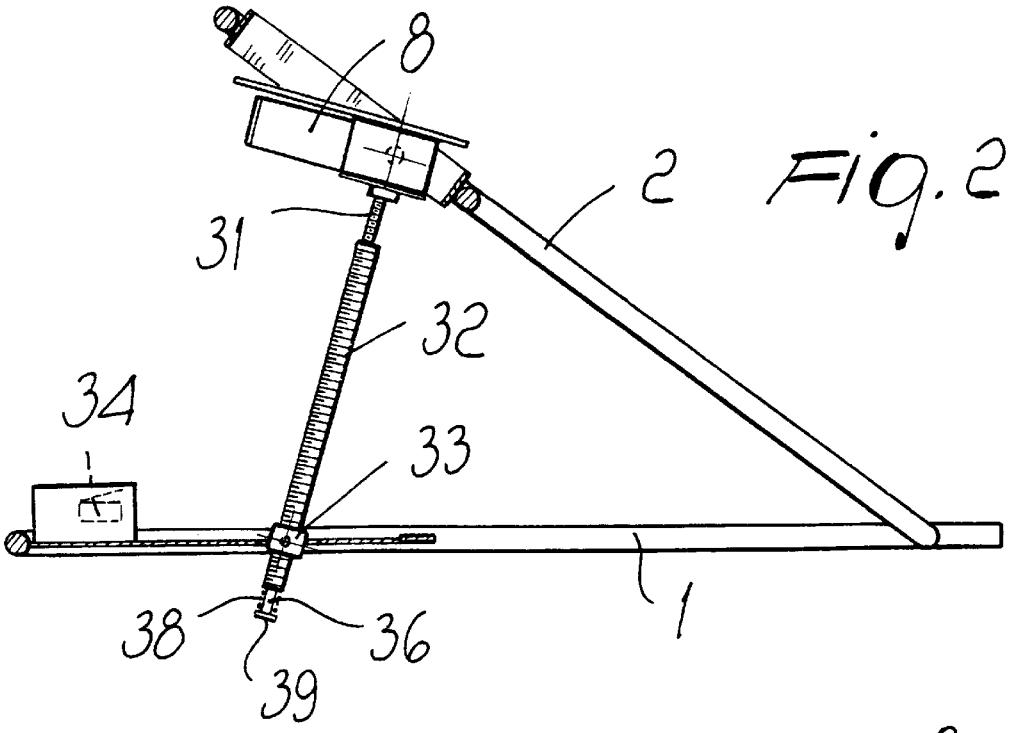
FIG. 21 is a side view of a variation of the eighth embodiment of the device according to the invention.

FIG. 21 shows a variation of the eighth embodiment of the device according to the invention shown in FIG. 20.

This figure shows that the gearmotor 8 is rigidly coupled to the second structure 2 and that the threaded bar 31 is also fixed to the second structure 2; the internally and externally threaded tube 32 is instead screwed into the female thread 33, which is fixed to the first structure 1 so that it can swivel.

A microswitch 34 is meant to interrupt the descent of the second structure 2, whilst a spring 38, arranged around a non-threaded portion 36, provides the upper stroke limit at the end that lies opposite to the end where the threaded bar 31 is connected to the second structure 2.

A nut 39 constitutes an abutment for the spring 38, which has a second abutment in the beginning of the threaded portion of the tube 32, which protrudes with respect to the non-threaded portion 36.

The device according to the invention, shown in FIG. 21, is also arranged at the centerline of the bed.

With reference to the above figure, operation of the device according to the invention is as follows.

The threaded bar 31 shifts, under the actuation of the gearmotor 8, inside the threaded tube 32, which in turn can perform a translatory motion within the female thread 33 and is rotated by the threaded bar 31.

The descending stroke limit is provided by the microswitch 34, which switches off the motor when the second structure 2 strikes it during descent.

The upper stroke limit is instead produced by the non-threaded portion 36 of the internally and externally threaded tube, which together with the spring 38 places the motor in idle mode because the non-threaded portion does not pass through the female thread 33 and the spring 38 prevents motor burnout: this occurs by continuously reengaging, by means of the spring, the threaded portion with the female thread, in contrast with the lifting movement imparted by the motor. A sort of hopping motion thus occurs which indicates the upper stroke limit.

Figure 22:
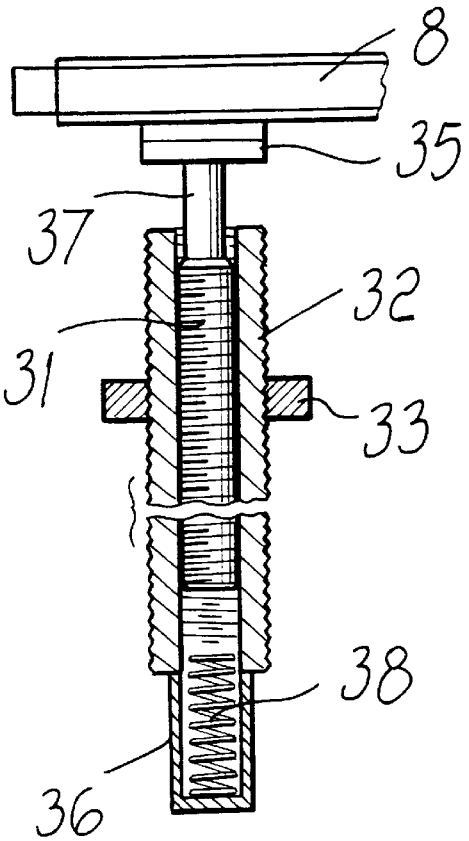
FIG. 22 is a sectional side view of a variation of the device according to the invention, shown in FIG. 21.

With reference now to FIG. 22, it is illustrated another variation of FIG. 20, which is similar to FIG. 21 but in which the lower stroke limit is determined by the non-threaded portion 36 of the tube 32, thus avoiding use of the microswitch 34.

The upper stroke limit is instead determined by the presence of a non-threaded portion 37 of the threaded bar 31, which is arranged in contact with a thrust bearing 35.

The spring 38 is inserted in this case within the tube 32, at its end portion which lies opposite to the gearmotor 8. The tube 32 is closed at said end portion.

The spring 38 causes the hopping motion of the threaded bar 31 when its non-threaded portion tends to enter the tube 32 and motor burnout is thus prevented.

Figure 23:
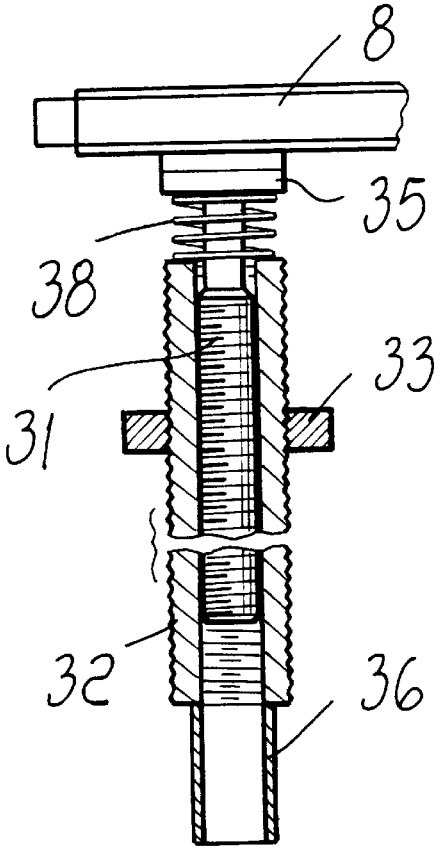
FIG. 23 is a sectional side view of a further variation of the device according to the invention, shown in FIG. 21.

With reference now to FIG. 23, it is illustrated another variation, in which the spring 38 is arranged between the thrust bearing 35 and the tube 32 in order to provide the lower (descent) stroke limit.

As additional variations, not shown in the figures, it is possible for example to have the motor 8 remain motionless in the idle position, i.e., in the stroke limit position, and to have the female thread 31 move instead, without providing any pusher spring.

As an alternative, it is possible to make the motor support move in the idle position whilst the female thread remains motionless.

Finally, all the details may be replaced with other technically equivalent elements.

In practice, the materials employed, so long as they are compatible with the specific use, as well as the dimensions, may be any according to requirements and to the state of the art.

What is claimed is:

1. A pillow lifting device particularly for beds, comprising: a first fixed structure, which can be arranged at a region where the user's head is meant to rest; a second structure, which is pivoted to said first fixed structure at one end and is adapted to support a mattress; and means for lifting or lowering said second structure with respect to said first fixed structure constituted by at least one elongated element actuated by a motor, said means for lifting or lowering the second structure comprising a threaded bar inserted in an internally and externally threaded tube which is in turn screwed in a female thread which is fixed to the first structure so that it can swivel, said motor being provided coupled to said second structure, to rotate said threaded bar, said internally and externally threaded tube lowering, during a lowering step of said second structure, under said first structure.

2. The device according to claim 1, wherein said tube has a non-threaded end portion which has a smaller diameter and is suitable to constitute an upper stroke limit when said threaded tube screws into said female thread, a pusher spring being provided around said non-threaded portion, said spring abutting against an end nut, a microswitch constituting lower stroke limit means.

3. The device according to claim 1, wherein said threaded tube is provided with a non-threaded end portion and wherein said threaded bar has a non-threaded upper portion, a pusher spring being inserted in said threaded tube, at its non-threaded end portion, said end portion being closed at its end.

4. The device according to claim 1, wherein said threaded tube has a non-threaded end portion and said threaded bar has a non-threaded upper portion, a pusher spring being interposed between said threaded tube and a thrust bearing rigidly coupled to the motor, said pusher spring being wound around said upper non-threaded portion of the threaded bar.

5. The device according to claim 1, wherein said first and second structures have a tubular configuration, said second structure being shorter than said first structure.

6. The device according to claim 1, wherein said first and second structures are arranged below a mattress, for lying on the structure of the bed, at the region for the resting of the user's head.

7. The device according to claim 1, wherein when the chosen lifting position of said second structure with respect to said first structure is reached, power supply terminals of said motor means are shorted in order to produce a counterelectromotive force which is adapted to prevent the unwanted lowering of said second structure with respect to said first structure.

* * * * *